US010537213B2

(12) United States Patent
Imai et al.

(10) Patent No.: US 10,537,213 B2
(45) Date of Patent: Jan. 21, 2020

(54) HAND DRYER APPARATUS

(71) Applicant: MITSUBISHI ELECTRIC CORPORATION, Chiyoda-ku, Tokyo (JP)

(72) Inventors: Yukimichi Imai, Tokyo (JP); Yasuyuki Itoigawa, Tokyo (JP); Takaki Kobayashi, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 93 days.

(21) Appl. No.: 15/571,146

(22) PCT Filed: Aug. 5, 2015

(86) PCT No.: PCT/JP2015/072273
§ 371 (c)(1),
(2) Date: Nov. 1, 2017

(87) PCT Pub. No.: WO2017/022110
PCT Pub. Date: Feb. 9, 2017

(65) Prior Publication Data
US 2018/0168411 A1 Jun. 21, 2018

(51) Int. Cl.
*A47K 10/48* (2006.01)
*F24H 3/04* (2006.01)

(52) U.S. Cl.
CPC ..... *A47K 10/48* (2013.01); *F24H 3/0405* (2013.01)

(58) Field of Classification Search
CPC ..... A47K 10/48; F24H 3/0405
See application file for complete search history.

(56) References Cited

U.S. PATENT DOCUMENTS

| | | | | |
|---|---|---|---|---|
| 6,769,197 | B1 | 8/2004 | Tai | |
| 7,039,301 | B1 | 5/2006 | Aisenberg et al. | |
| 9,101,251 | B1 * | 8/2015 | Moorhouse | F26B 21/06 |
| 2012/0017460 | A1 | 1/2012 | Kikuchi et al. | |

(Continued)

FOREIGN PATENT DOCUMENTS

| | | | |
|---|---|---|---|
| CN | 102469897 | A | 5/2012 |
| CN | 103607935 | A | 2/2014 |
| JP | H 10-257994 | A | 9/1998 |

(Continued)

OTHER PUBLICATIONS

Office Action issued in corresponding Australian Patent Application No. 2015404655, dated Jun. 6, 2018 (6 pages).

(Continued)

*Primary Examiner* — Jessica Yuen
(74) *Attorney, Agent, or Firm* — Buchanan Ingersoll & Roooney PC

(57) ABSTRACT

A hand dryer apparatus includes: a casing having an air inlet port that admits air and a nozzle that discharges the air admitted through the air inlet port; a fan that is housed in the casing and generates an airflow directed from the air inlet port toward the nozzle; and an intake air pathway body placed in the casing and forming an intake air pathway extending from the air inlet port toward the fan. The casing includes a base supporting the fan and a cover having the air inlet port and removable from the base. The intake air pathway body is fixed on the cover.

5 Claims, 13 Drawing Sheets

(56) References Cited

U.S. PATENT DOCUMENTS

2012/0285033 A1 11/2012 Hsu

FOREIGN PATENT DOCUMENTS

| | | | |
|---|---|---|---|
| JP | 3970762 | B2 | 9/2007 |
| JP | 2008-000211 | A | 1/2008 |
| JP | 5092505 | B2 | 12/2012 |
| TW | 201031374 | A1 | 9/2010 |
| TW | 201242560 | A1 | 11/2012 |
| WO | 2017/017736 | A1 | 2/2017 |

OTHER PUBLICATIONS

International Search Report (PCT/ISA/210) dated Sep. 29, 2015, by the Japan Patent Office as the International Searching Authority for International Application No. PCT/JP2015/072273.
Written Opinion (PCT/ISA/237) dated Sep. 29, 2015, by the Japan Patent Office as the International Searching Authority for International Application No. PCT/JP2015/072273.
Examination Report dated Jan. 17, 2017, issued by the Taiwan Intellectual Property Office for corresponding Taiwanese Application No. 105102304 (with partial English translation).
Office Action dated Sep. 4, 2019 by the State Intellectual Property Office of People's Republic of China in corresponding Chinese Patent Application No. 201580080738.6 and an English translation of the Office Action. (12 pages).

* cited by examiner

HAND DRYER APPARATUS

FIELD

The present invention relates to a hand dryer apparatus that blows a high-speed airflow toward a washed wet hand to dry the hand.

BACKGROUND

A type of hand dryer apparatus for drying a wet hand blows a high-speed airflow discharged through a nozzle toward a hand to blow off water droplets clinging to the hand to dry the hand. Such a hand dryer apparatus includes, inside a casing, a fan that generates airflow. An air inlet port that admits air and the nozzle that discharges the air admitted through the air inlet port are formed in the casing. An intake air pathway that connects the air inlet port and the fan and a discharge air pathway that connects the fan and the nozzle are also provided inside the casing. Patent Literature 1 discloses a hand dryer apparatus that has an air inlet port that is formed rearward of the nozzle.

CITATION LIST

Patent Literature

Patent Literature 1: Japanese Patent No. 5092505

SUMMARY

Technical Problem

Some of the water droplets blown off a hand may be admitted through the air inlet port, which is placed rearward of the nozzle. When a cover is removed from the hand dryer apparatus to perform maintenance on the inside of the casing, part of the inside is exposed. If the air inlet port is formed in the cover, a portion of the cover where the air inlet port is located abuts on the intake air pathway with the cover attached. In such a configuration, a connection portion between the cover and the intake air pathway is located inside the casing immediately behind the air inlet port. Hence, water droplets admitted from the air inlet port may pass through the connection portion between the air inlet port and the intake air pathway, i.e., through the gap between the air inlet port and the intake air pathway, and thus may enter the casing.

The present invention has been achieved in view of the above, and an object of the present invention is to provide a hand dryer apparatus that can prevent entry of water into a casing.

Solution to Problem

To solve the problem and achieve the object described above, a hand dryer apparatus according to an aspect of the present invention, includes: a casing having an air inlet port that admits air and a nozzle that discharges the air admitted through the air inlet port; a fan that is housed in the casing and generates an airflow directed from the air inlet port toward the nozzle; and an intake air pathway body placed in the casing and forming an intake air pathway extending from the air inlet port toward the fan. The casing includes: a base supporting the fan; and a cover having the air inlet port and removable from the base. The intake air pathway body is fixed on the cover.

Advantageous Effects of Invention

A hand dryer apparatus according to the present invention produces an effect of enabling prevention of entry of water into a casing.

DESCRIPTION OF EMBODIMENTS

A hand dryer apparatus according to embodiments of the present invention will now be described in detail with reference to the drawings. The present invention is not limited to the embodiments.

First Embodiment

Figure 1:
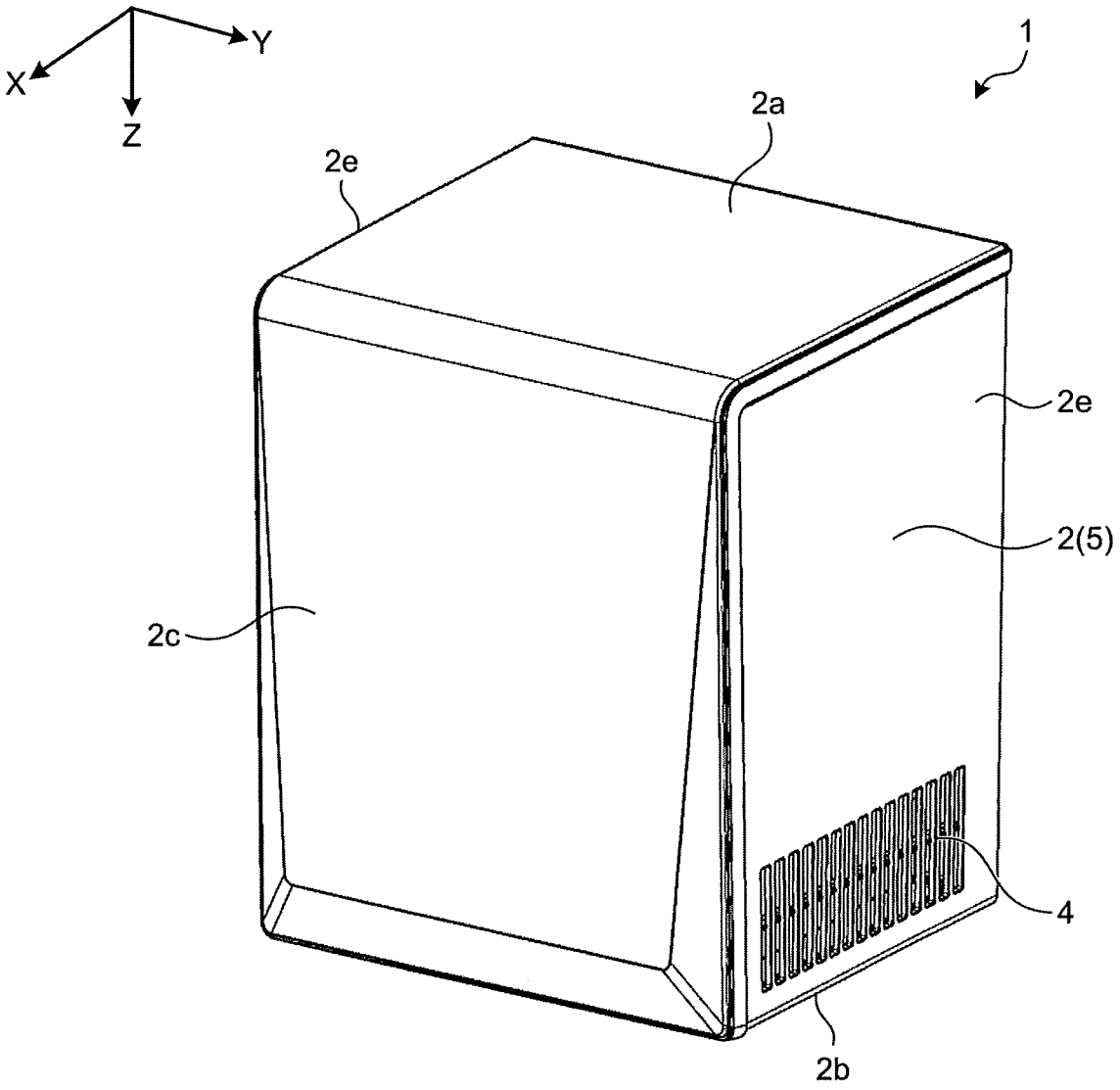
FIG. 1 is an external perspective view of a hand dryer apparatus according to a first embodiment of the present invention.
Figure 2:
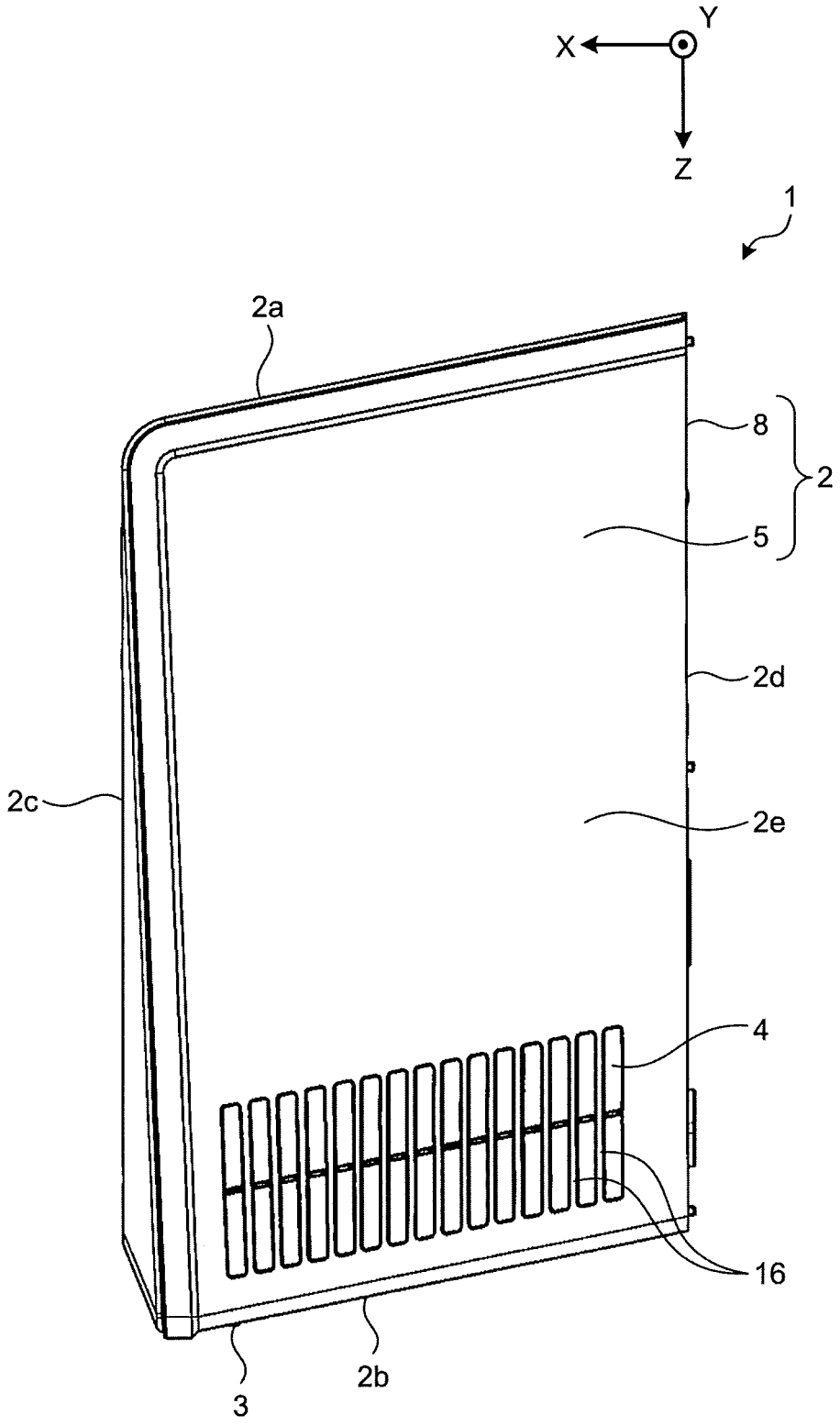
FIG. 2 is a side view of the hand dryer apparatus according to the first embodiment.
Figure 3:
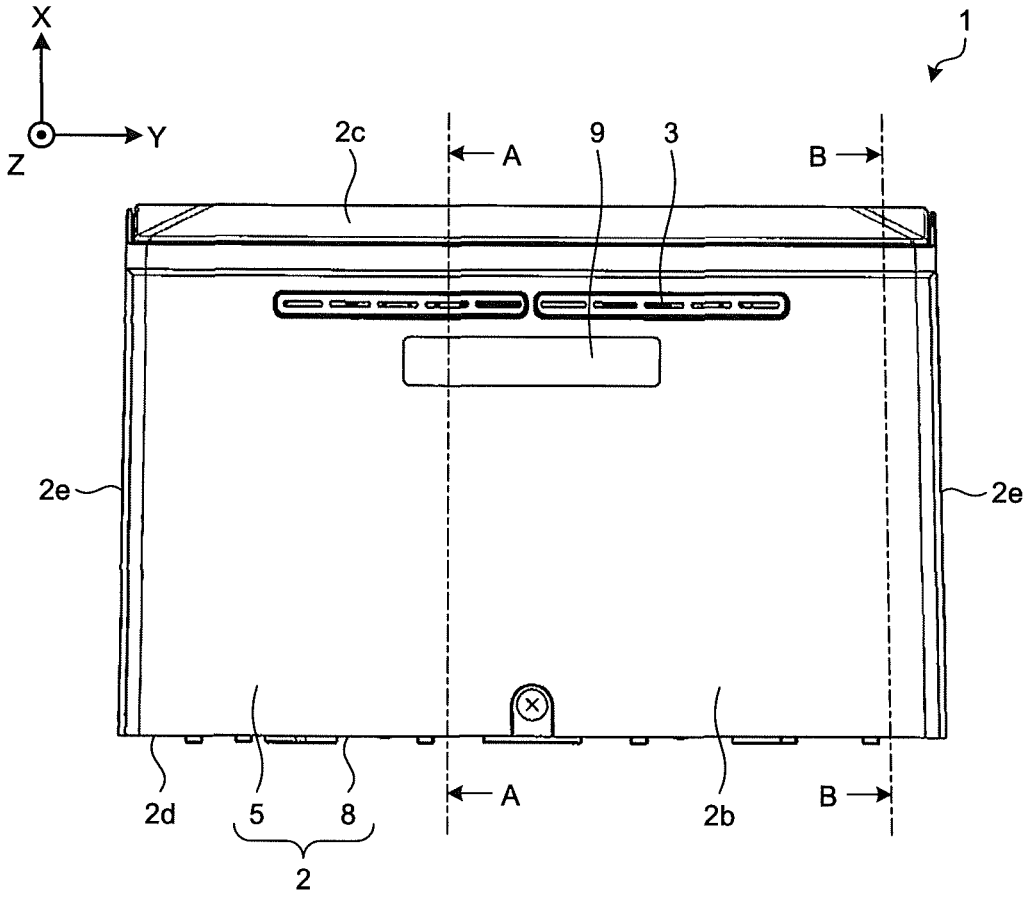
FIG. 3 is a bottom view of the hand dryer apparatus according to the first embodiment.
Figure 4:
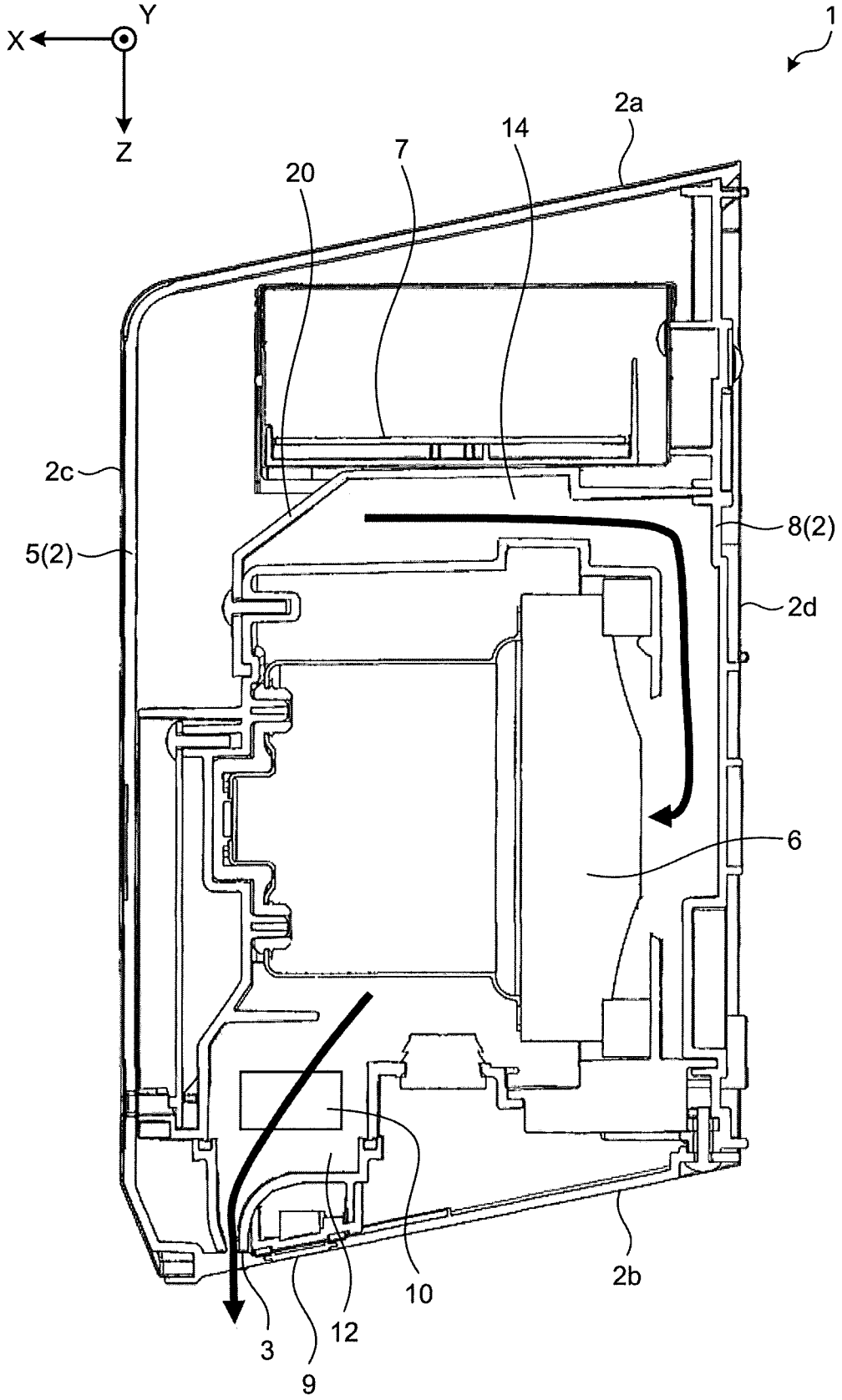
FIG. 4 is a sectional view of the hand dryer apparatus according to the first embodiment, as viewed along line A-A illustrated in FIG. 3.

FIG. 1 is an external perspective view of a hand dryer apparatus according to a first embodiment of the present invention. FIG. 2 is a side view of the hand dryer apparatus according to the first embodiment. FIG. 3 is a bottom view of the hand dryer apparatus according to the first embodiment. FIG. 4 is a sectional view of the hand dryer apparatus according to the first embodiment, as viewed along line A-A illustrated in FIG. 3.

In front-and-back directions used in the description below, a positive direction along an X axis illustrated in FIG. 1 is forward and a negative direction along the x axis is rearward. In right-and-left directions used in the description below, a positive direction along a Y axis is rightward and a negative direction along the Y axis is leftward. In up-anddown directions used in the description below, a positive direction along a Z axis is downward and a negative direction along the Z axis is upward. All the arrows in the figures except those indicating the X axis, the Y axis, and the Z axis and those indicating cross sections represent flows of air.

A hand dryer apparatus 1 includes a casing 2, which has a box-like shape and forms a contour as illustrated in FIG. 1. As illustrated in FIG. 2, an upper face 2*a* and a lower face 2*b* of the casing 2 are tilted faces each having a forward portion located downward of a rearward portion. Side faces 2*e* of the casing 2 each have a parallelogram-like shape, and a front face 2*c* and a rear face 2*d* of the casing 2 are vertical faces in an installation position of the hand dryer apparatus 1. The side faces 2*e* are also vertical faces in the installation position of the hand dryer apparatus 1.

Figure 5:
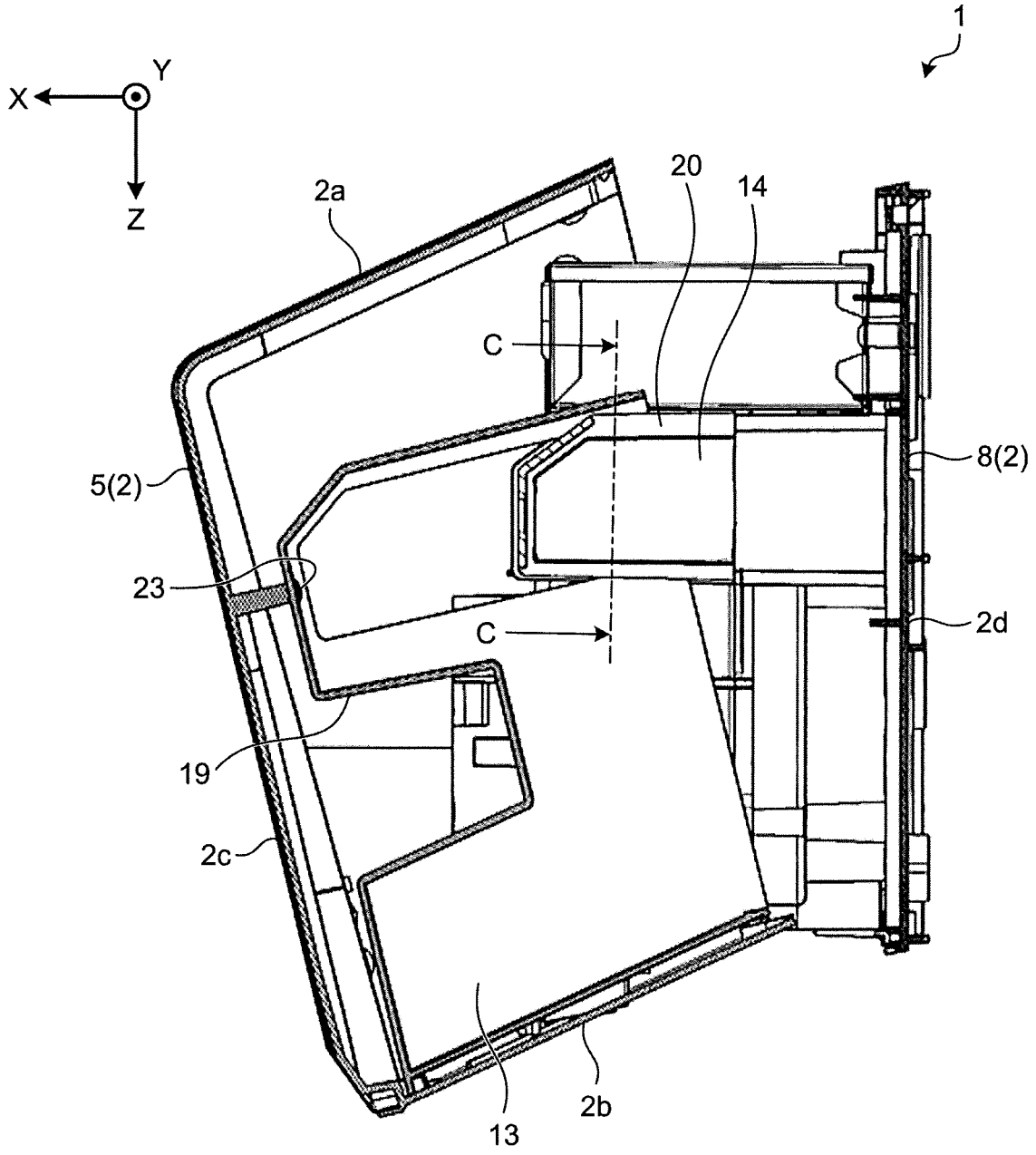
FIG. 5 is a diagram illustrating a process in which a cover of the hand dryer apparatus according to the first embodiment is removed.

The casing 2 includes a base 8 and a cover 5. The base 8 forms the rear face 2*d* of the casing 2. The cover 5 forms the upper face 2*a*, the lower face 2*b*, the front face 2*c*, and the side faces 2*e* of the casing 2. FIG. 5 is a diagram illustrating a process in which the cover 5 of the hand dryer apparatus 1 according to the first embodiment is removed. As illustrated in FIG. 5, the cover 5 is removable from the base 8.

As illustrated in FIGS. 3 and 4, a nozzle 3 and a hand detection sensor 9 are provided in the lower face 2*b* of the cover 5. The nozzle 3 is an outlet port that discharges a high-speed airflow, and the hand detection sensor 9 determines whether a hand is present in a location downward of the lower face 2*b* where the high-speed airflow is blown. As illustrated in FIG. 2, the side face 2*e* of the cover 5 has an air inlet port 4, which admits air. The air inlet port 4 is divided into a plurality of openings by a grating 16. The air inlet port 4 is placed upward of the outlet port 3. Because the air inlet port 4 is placed upward of the nozzle 3, water droplets blown off a hand are less likely to reach the air inlet port 4. As illustrated in FIG. 2, the air inlet port 4 is shaped like a parallelogram whose base has a forward end that is located downward of a rear end of the base. Because the air inlet port 4 is divided into the plurality of openings by the grating 16, entry of a finger or the like into the air inlet port 4 can be prevented.

The cover 5 may be formed of resin. Forming the cover 5 using resin containing an antibacterial agent can inhibit multiplication of bacteria. Alternatively, the cover 5 may be formed of metal. Forming the cover 5 using metal can improve the robustness of the casing 2.

Figure 6:
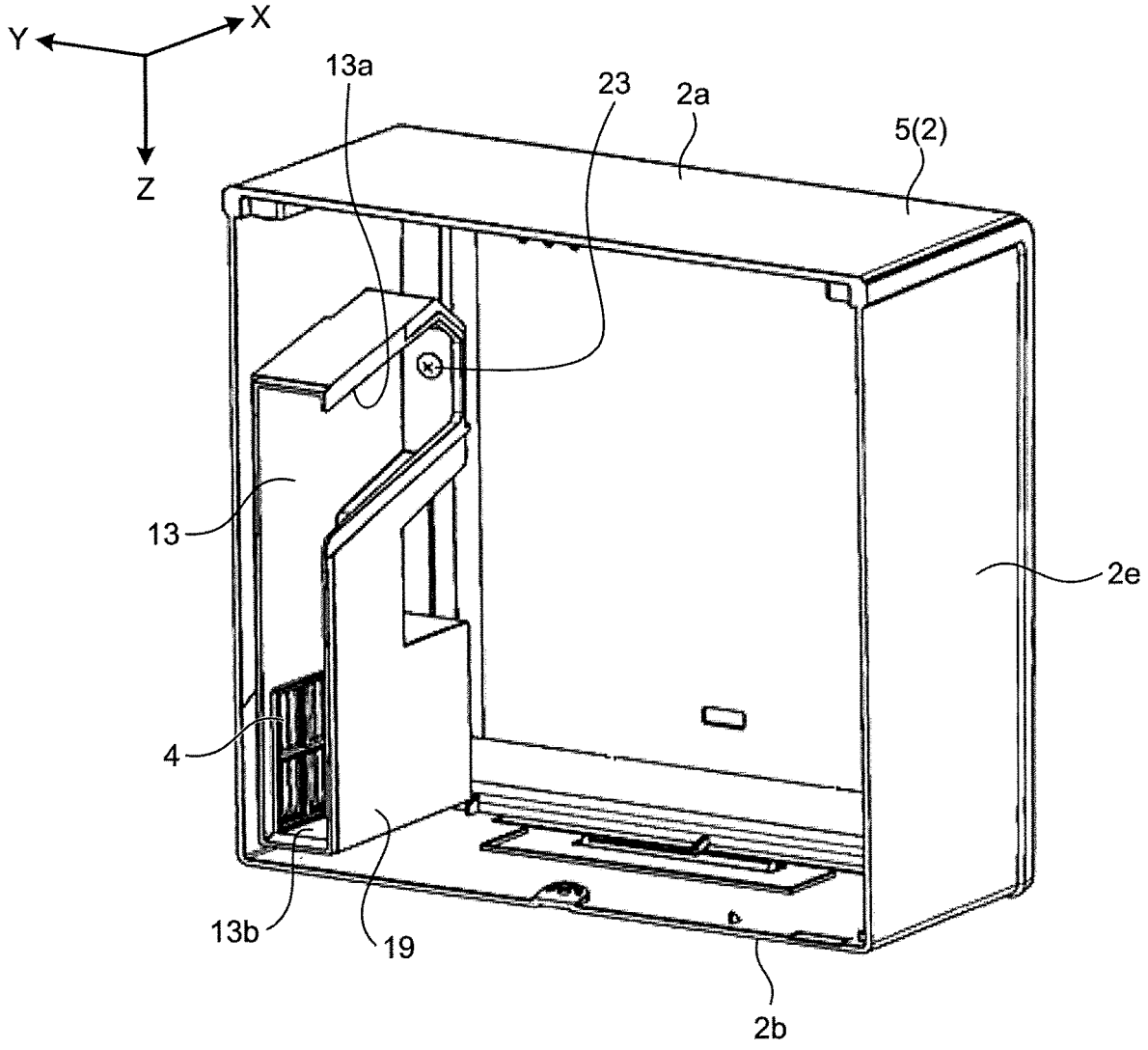
FIG. 6 is a perspective view of the cover according to the first embodiment, as viewed from behind.

FIG. 6 is a perspective view of the cover 5 according to the first embodiment, as viewed from behind. An intake air pathway 13, which extends from the air inlet port 4 toward a fan 6 to be described hereinafter (see also FIG. 4), is formed inside the cover 5, i.e., inside the casing 2. The intake air pathway 13 is formed so as to extend upward from the air inlet port 4. The intake air pathway 13 is formed by using an intake air pathway body 19, which is placed inside the cover 5. The intake air pathway body 19 is fixed to the cover 5 with a screw 23. Thus, when the cover 5 is removed from the base 8, the cover 5 and the intake air pathway body 19 are removed together from the base 8.

A connection aperture 13*a*, which is an opening, is formed in a side face of the intake air pathway 13 that is located upward of the air inlet port 4. In the first embodiment, a rearward face of the intake air pathway 13 is entirely open. The rearward opening of the intake air pathway 13 is closed by the base 8 when the cover 5 is attached to the base 8.

Figure 7:
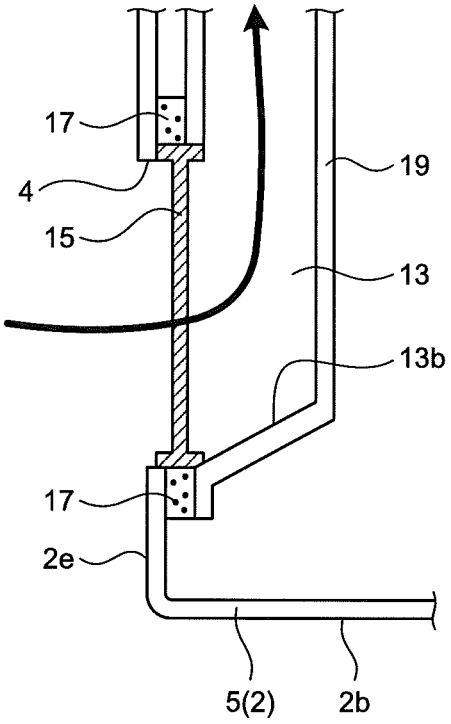
FIG. 7 is a partially enlarged sectional view of the cover according to the first embodiment, enlarging a portion including an air inlet port.

FIG. 7 is a partially enlarged sectional view of the cover 5 according to the first embodiment, enlarging a portion including the air inlet port 4. A gasket 17 is interposed between the cover 5 and the intake air pathway body 19 such that the gasket 17 surrounds the air inlet port 4. The gasket 17 is formed of, for example, rubber. Because the gasket 17 is interposed between the cover 5 and the intake air pathway body 19, dust and water are less likely to enter the casing 2 through the gap between the cover 5 and the intake air pathway body 19. Dust contained in the air admitted through the air inlet port 4 is less likely to enter the intake air pathway 13 due to a filter 15 placed in the air inlet port 4.

Figure 8:
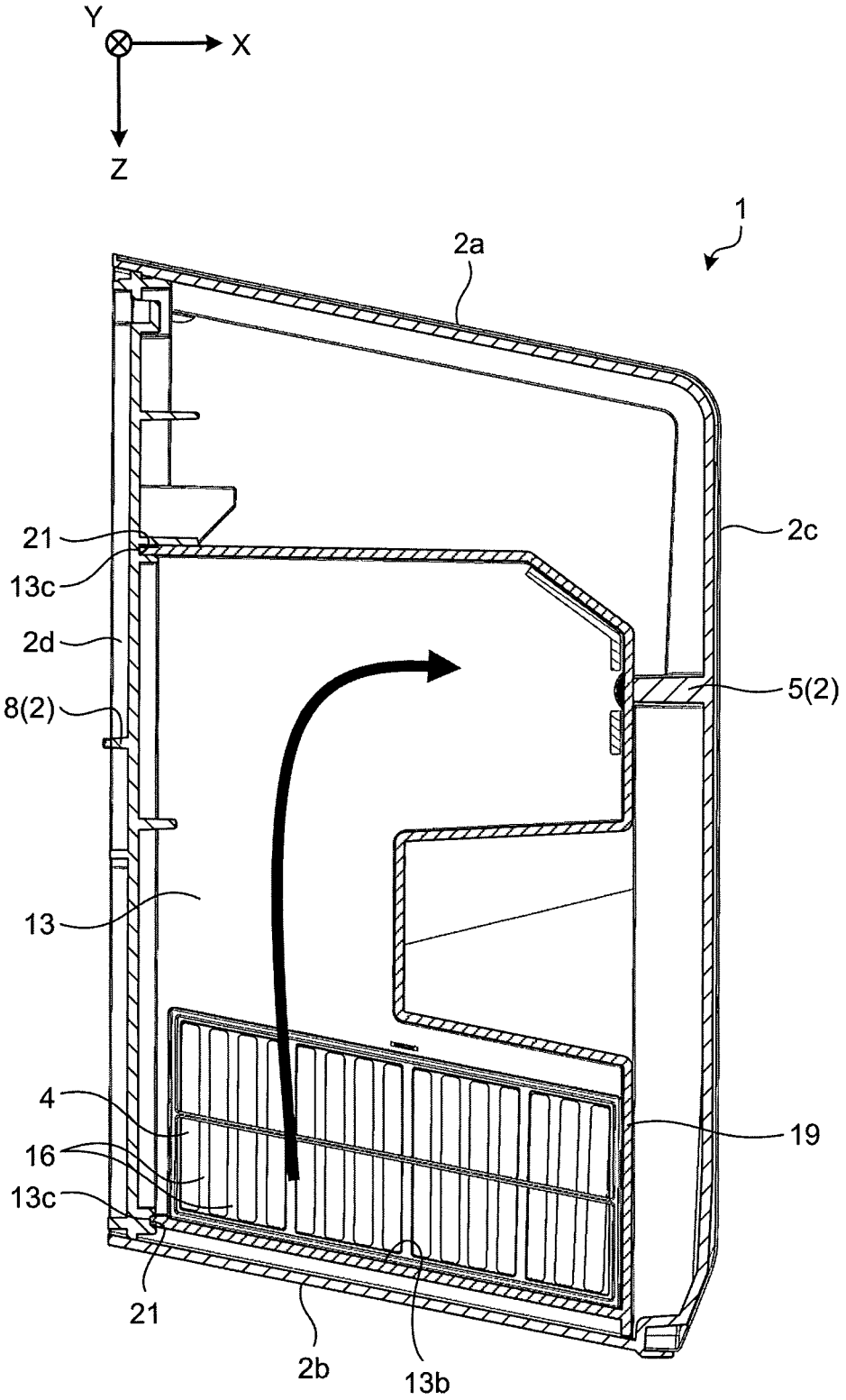
FIG. 8 is a sectional view of the hand dryer apparatus according to the first embodiment, as viewed along line B-B illustrated in FIG. 3.

As illustrated in FIG. 7, a bottom face 13*b* of the intake air pathway 13 is tilted such that a portion of the bottom face 13*b* that is located on an air inlet port 4 side is lowered at a connection portion between the air inlet port 4 and the intake air pathway body 19. FIG. 8 is a sectional view of the hand dryer apparatus according to the first embodiment, as viewed along line B-B illustrated in FIG. 3. As illustrated in FIG. 8, an edge portion 13*c* of the intake air pathway body 19 that is located on the base 8 side is fitted, as a fitting portion, in a groove 21 formed in the base 8. Alternatively, a groove may be formed in the intake air pathway body 19 and a fitting portion may be formed on the base 8. As illustrated in FIG. 8, the bottom face 13*b* of the intake air pathway body 19 is a tilted face having a forward portion located downward of a rearward portion of the bottom face 13*b*.

Figure 9:
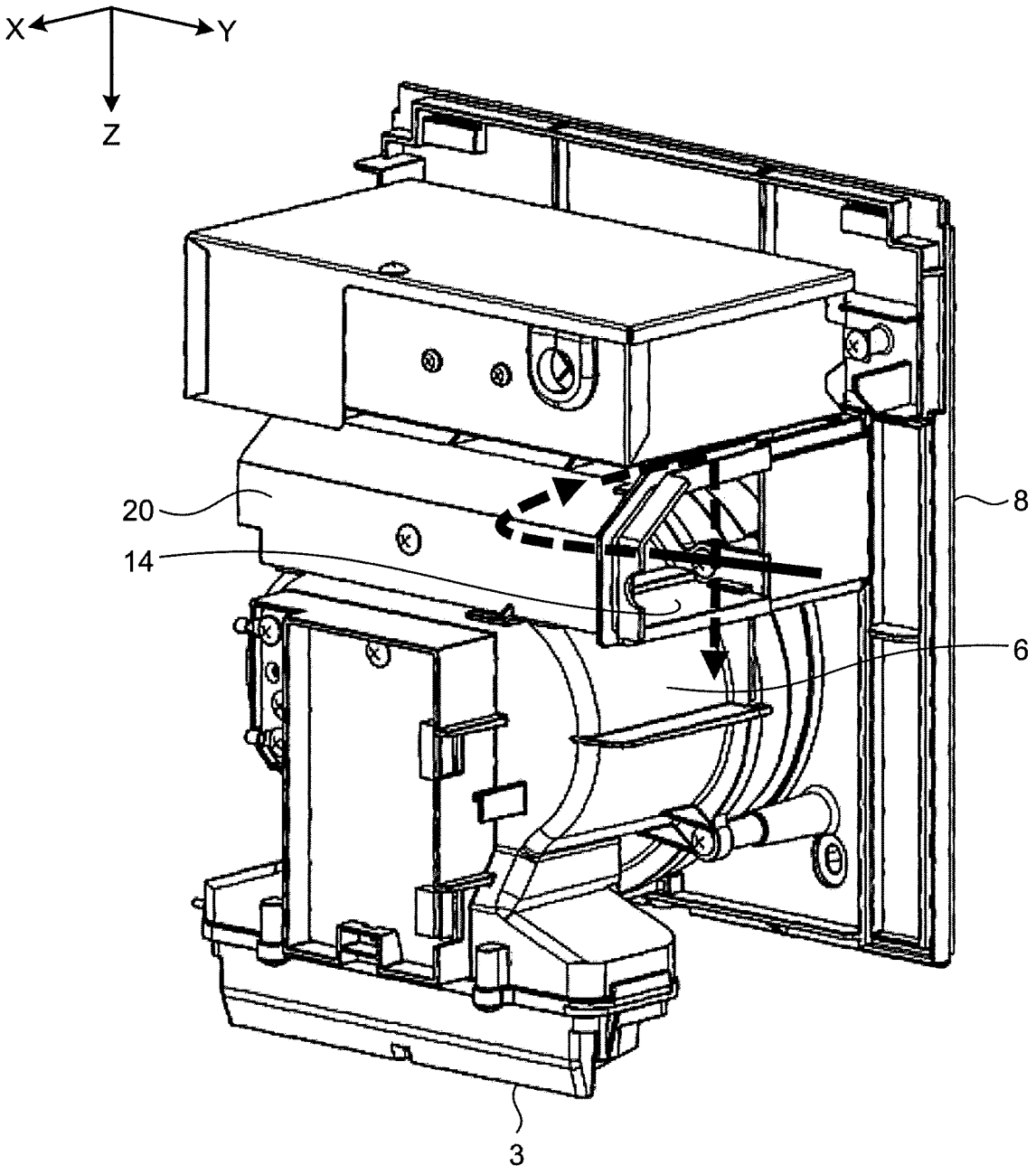
FIG. 9 is a perspective view of a base according to the first embodiment.
Figure 10:
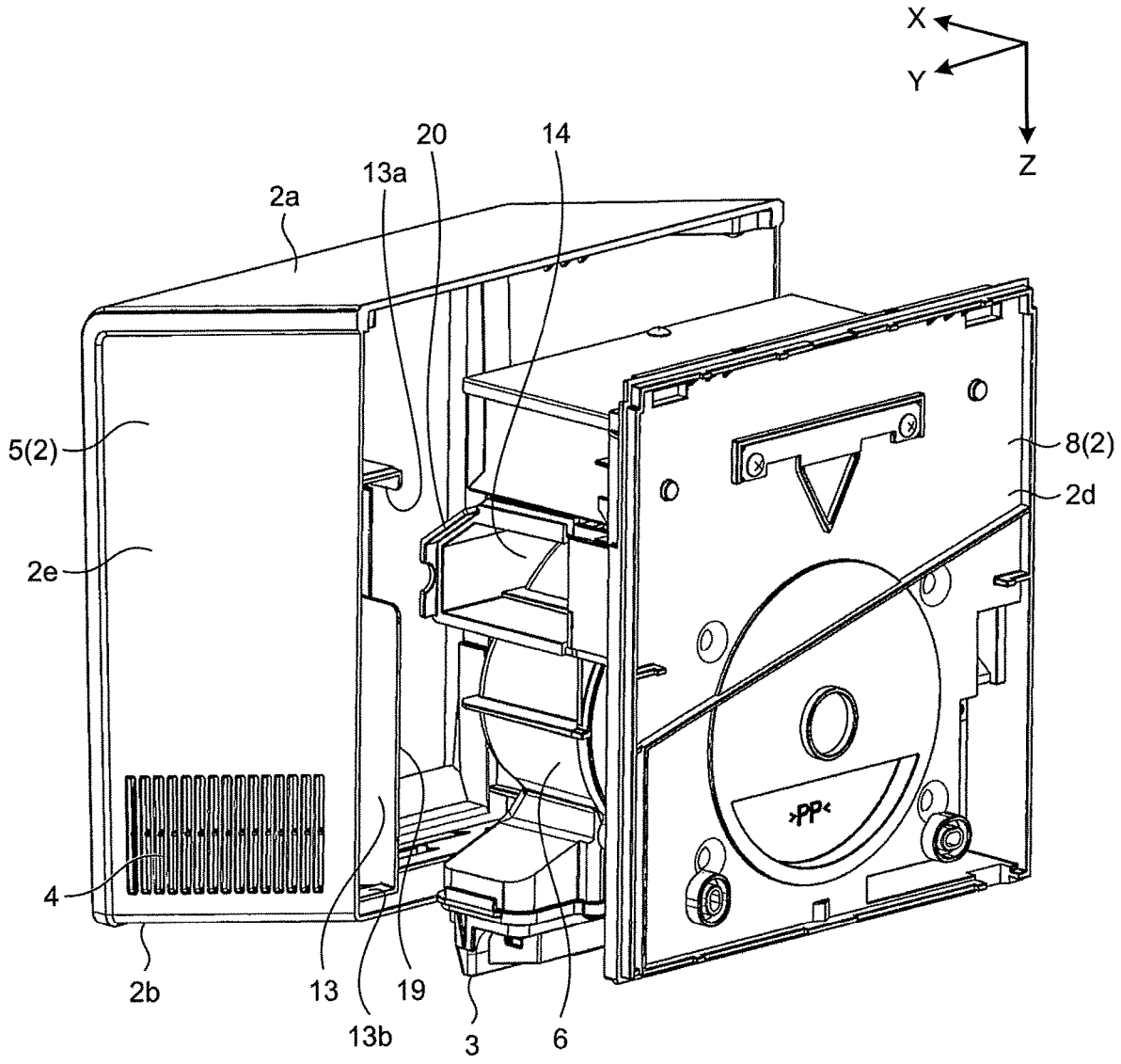
FIG. 10 is a perspective view of the hand dryer apparatus according to the first embodiment, as viewed from behind with the cover removed.

As illustrated in FIG. 4, the fan 6 is placed inside the casing 2. FIG. 9 is a perspective view of the base 8 according to the first embodiment. FIG. 10 is a perspective view of the hand dryer apparatus 1 according to the first embodiment, as viewed from behind with the cover 5 removed. As illustrated in FIG. 9, the fan 6 is fixed on the base 8.

Figure 11:
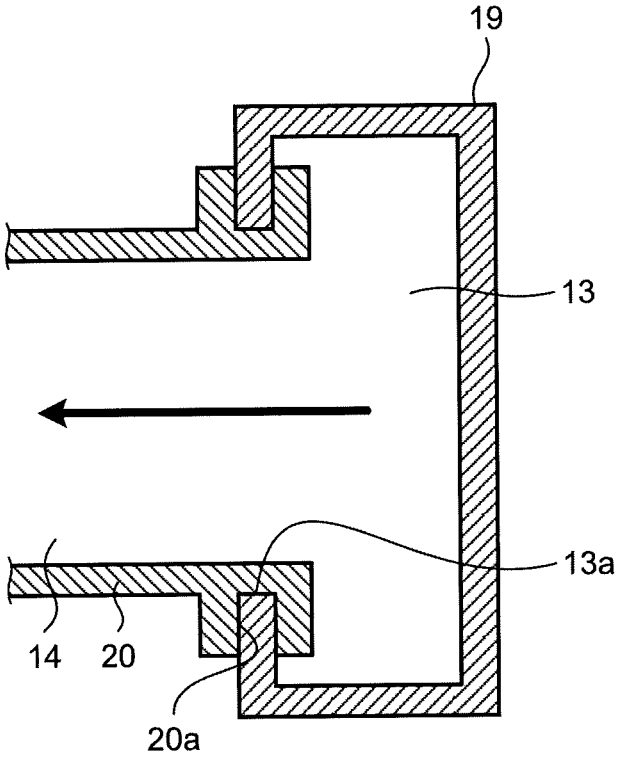
FIG. 11 is a partial sectional view of the hand dryer apparatus according to the first embodiment, as viewed along line C-C illustrated in FIG. 5.

An intermediate air pathway body 20 is also fixed on the base 8. The intermediate air pathway body 20 is a member that forms an intermediate air pathway 14, which connects the intake air pathway 13 and the fan 6. FIG. 11 is a partial sectional view of the hand dryer apparatus according to the first embodiment, as viewed along line C-C illustrated in FIG. 5. The intermediate air pathway body 20 is connected to the connection aperture 13*a* of the intake air pathway body 19.

An edge portion of the connection aperture 13*a* of the intake air pathway body 19 is fitted, as a fitting portion, in a groove 20*a* formed in the intermediate air pathway body 20 at a connection portion between the intermediate air pathway body 20 and the intake air pathway body 19. With reference back to FIG. 4, a discharge air pathway 12, which connects the nozzle 3, which is formed in the casing 2, and the fan 6, is formed inside the casing 2. A heater 10, which warms air passing through the discharge air pathway 12, is placed in the discharge air pathway 12. A control unit 7, which controls the operation of the hand dryer apparatus 1, is also placed inside the casing 2. An operation switch for adjusting the amount of airflow and a room thermostat that detects the temperature of a room are also placed inside the casing 2, although their illustration is omitted.

In the hand dryer apparatus 1 described above, when a hand is placed under the casing 2 and the hand detection sensor 9 detects the presence of the hand near the nozzle 3, the control unit 7 enables the fan 6 to operate. The operation of the fan 6 generates an airflow that is directed from the air inlet port 4 toward the nozzle 3 of the casing 2. Specifically, when the fan 6 is operated, air is admitted through the air inlet port 4, passes through the intake air pathway 13, the intermediate air pathway 14, the fan 6, and the discharge air pathway 12, and is discharged through the nozzle 3. The air that is discharged through the nozzle 3 blows to the hand placed under the casing 2 to blow off water droplets clinging to the hand. When the hand is removed from under the casing 2 and the hand detection sensor 9 detects the absence of a hand near the nozzle 3, the control unit 7 stops the operation of the fan 6. If the temperature of the room detected by the room thermostat is low, the control unit 7 enables the heater 10 to be energized to raise the temperature of the air that is to be discharged through the nozzle 3.

The nozzle 3 is formed in the lower face 2*b* of the casing 2, whereas the air inlet port 4 is formed in the side face 2*e*, which is a vertical face. That is, the air inlet port 4 is placed upward of the nozzle 3; thus, water droplets blown off a hand are less likely to be admitted into the intake air pathway 13 through the air inlet port 4.

Additionally, the intake air pathway body 19 is fixed on the cover 5 so that the intake air pathway body 19 can be removed together with the cover 5. Hence, the gasket 17 can be interposed between the intake air pathway body 19 and the cover 5 so as to improve the closeness between the intake air pathway body 19 and the cover 5. Thus, even if water droplets are admitted into the intake air pathway 13, the water droplets are less likely to enter the casing 2 through the gap between the intake air pathway body 19 and the cover 5. Additionally, because the intake air pathway body 19 is fixed on the cover 5, creation of a gap between the intake air pathway body 19 and the cover 5 does not depend on how the cover 5 is attached to the base 8. Thus, water is even less likely to enter the casing 2 through the gap between the intake air pathway body 19 and the cover 5.

Additionally, because a connection portion between the intake air pathway 13 and the intermediate air pathway 14 is placed upward of the air inlet port 4, water droplets that are admitted into the intake air pathway 13 are less likely to reach the connection portion between the intake air pathway body 19 and the intermediate air pathway body 20. Thus, water is less likely to enter the casing 2 through the connection portion between the intake air pathway body 19 and the intermediate air pathway body 20. This effect is produced more reliably by achieving a configuration in which the lower end of the connection aperture 13*a* of the intake air pathway body 19 is located upward of the upper end of the air inlet port 4, i.e., achieving a configuration in which the entire connection aperture 13*a* of the intake air pathway body 19 is located upward of the entire air inlet port 4. Additionally, the need to increase complexity of the connecting structure between the intake air pathway body 19 and the intermediate air pathway body 20 to provide waterproof properties is eliminated; thus, such simplification of the structure can reduce costs.

As described above, the hand dryer apparatus 1 according to the first embodiment prevents entry of water into the casing 2 by using air pathways, from the air inlet port 4 up to a certain range, that are configured such that water is less likely to leak. Water is more likely to enter from the area of the connection aperture 13*a* than from the air inlet port 4, in which the gasket 17 is interposed between the cover 5 and the intake air pathway body 19; however, by placing the area of the connection aperture 13*a* upward of the air inlet port 4, water is less likely to reach the area of the connection aperture 13*a* and thereby the entry of water into the casing 2 is prevented.

Additionally, due to the tilting of the bottom face 13*b* of the intake air pathway 13 in such manner that the portion of the bottom face 13*b* that is located on the air inlet port 4 side is lowered as illustrated in FIG. 7, water droplets that have attached to the bottom face 13*b* are more likely to be guided toward the air inlet port 4 side and discharged to the outside through the air inlet port 4. Additionally, due to the tilting of the bottom face 13*b* in such a manner that a forward portion of the bottom face 13*b* is lowered as illustrated in FIG. 8, water droplets that have attached to the bottom face 13*b* can be guided forward. In this manner, water droplets are kept away from a connection portion between the intake air pathway body 19 and the base 8, and thereby the entry of water into the casing 2 from the connection portion between the intake air pathway body 19 and the base 8 can be prevented.

Additionally, although part of the noise generated by the fan 6 during the operation passes through the intermediate air pathway 14 and the intake air pathway 13 to leak from the casing 2 to the outside through the air inlet port 4, the noise is less likely to be transmitted to be perceived as noise by the user standing on the front face 2*c* side of the casing 2 because the air inlet port 4 is formed in the side face 2*e*.

Figure 12:
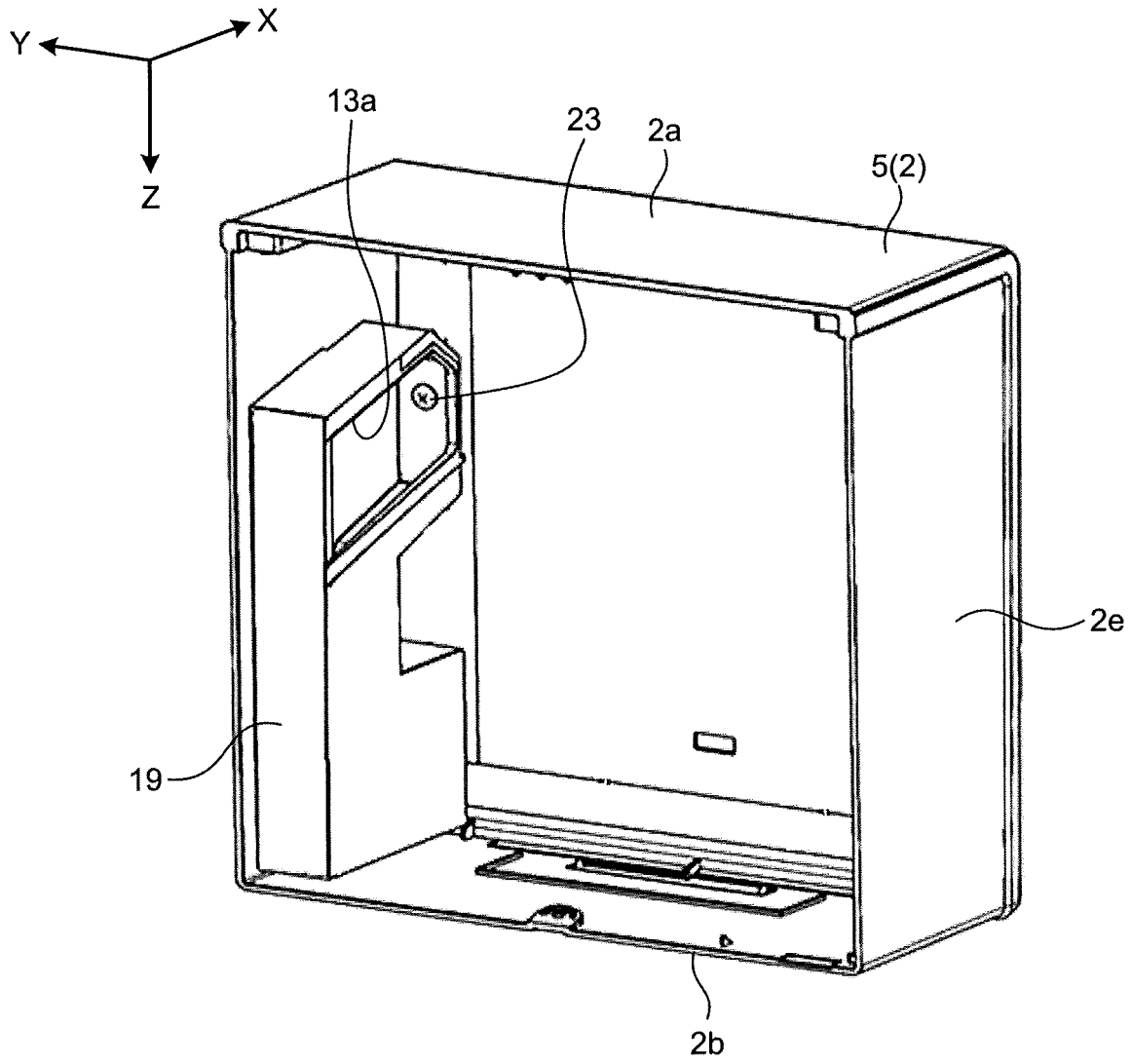
FIG. 12 is a perspective view of a first modification of an intake air pathway body in the first embodiment, illustrating the cover as viewed from behind.

FIG. 12 is a perspective view of a first modification of the intake air pathway body 19 in the first embodiment, illustrating the cover 5 as viewed from behind. As illustrated in FIG. 12, the intake air pathway body 19 may be formed with the rearward face closed.

Figure 13:
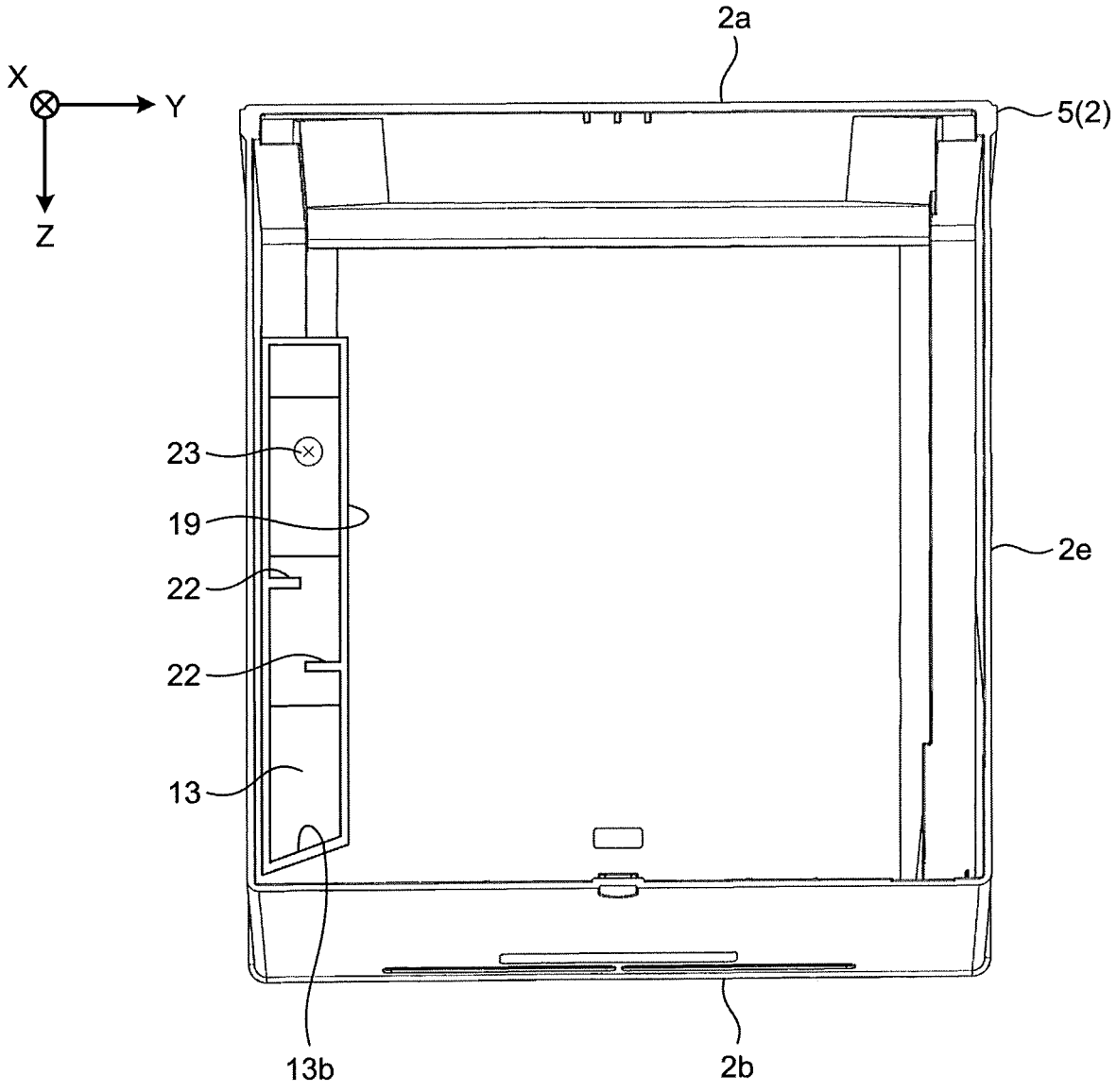
FIG. 13 is a diagram illustrating a second modification of the intake air pathway body in the first embodiment, illustrating the cover as viewed from behind.

FIG. 13 is a diagram illustrating a second modification of the intake air pathway body 19 in the first embodiment, illustrating the cover 5 as viewed from behind. As illustrated in FIG. 13, ribs 22 may be placed with intervals along the direction of an airflow on opposite wall surfaces of the intake air pathway body 19 such that the intake air pathway 13 has a labyrinth configuration. Providing such a labyrinth configuration using the ribs 22 in the intake air pathway 13 can achieve enhancement of the effect of allowing the noise to collide with the ribs 22 and the wall surfaces of the intake air pathway 13 and thereby attenuating the noise generated by the fan 6 during the operation. Additionally, water droplets that have been admitted into the intake air pathway 13 collide with the ribs 22; thus, the water droplets are even less likely to reach the connection portion between the intake air pathway body 19 and the intermediate air pathway body 20 (see also FIG. 9).

While an air pathway that connects the air inlet port 4 and the fan 6 is divided into the intake air pathway body 19 and the intermediate air pathway body 20 in the first embodiment, the intake air pathway body 19 and the intermediate air pathway body 20 may be formed as a single air pathway body, and such a single air pathway body may be fixed on the cover 5. The bottom face 13*b* of the intake air pathway 13 may be a horizontal face instead of the tilted face as illustrated in FIGS. 7 and 8.

Note that the configurations described in the foregoing embodiments are examples of the present invention; combining the present invention with other publicly known techniques is possible, and partial omissions and modifications are possible without departing from the spirit of the present invention.

REFERENCE SIGNS LIST

1 hand dryer apparatus; 2 casing; 2*a* upper face; 2*b* lower face; 2*c* front face; 2*d* rear face; 2*e* side face; 3 nozzle (outlet port); 4 air inlet port; 5 cover; 6 fan; 7 control unit; 8 base; 9 hand detection sensor; 10 heater; 12 discharge air pathway; 13 intake air pathway; 13*a* connection aperture; 13*b* bottom face; 14 intermediate air pathway; 15 filter; 16 grating; 17 gasket; 19 intake air pathway body; 20 intermediate air pathway body; 20*a* groove; 21 groove; 22 rib; 23 screw.

The invention claimed is:

1. A hand dryer apparatus, comprising:

a casing having an air inlet port that admits air and a nozzle that discharges the air admitted through the air inlet port;

a fan that is housed in the casing and generates an airflow directed from the air inlet port toward the nozzle; and an intake air pathway body placed in the casing and forming an intake air pathway configuring at least part of an air pathway connecting the air inlet port and the fan, wherein the casing comprises:

a base supporting the fan; and a cover having the air inlet port and being removably connected to the base, the intake air pathway body is fixed on the cover, and the cover and the intake air pathway body are removable from the base while the intake air pathway body remains fixed to the cover.

2. The hand dryer apparatus according to claim 1, further comprising an intermediate air pathway body forming an intermediate air pathway that connects the intake air pathway and the fan, wherein the intermediate air pathway body is fixed on the base.

3. The hand dryer apparatus according to claim 2, wherein a connection portion between the intake air pathway and the intermediate air pathway is placed upward of the air inlet port.

4. The hand dryer apparatus according to claim 3, wherein the cover has a vertical face, the air inlet port is formed in the vertical face, and a bottom face of the intake air pathway is configured with a tilted face that is tilted downward toward the air inlet port.

5. The hand dryer apparatus according to claim 2, wherein a groove is formed in one of the intake air pathway body and the intermediate air pathway body and a fitting portion formed in another of the intake air pathway body and the intermediate air pathway body is fitted in the groove at the connection portion between the intake air pathway and the intermediate air pathway.

* * * * *